US006587659B2

(12) United States Patent
Furuki et al.

(10) Patent No.: US 6,587,659 B2
(45) Date of Patent: Jul. 1, 2003

(54) IMAGE FORMING DEVICE

(75) Inventors: Manabu Furuki, Minamiashigara (JP); Koji Fukushima, Minamiashigara (JP); Yoshihiro Maekawa, Minamiashigara (JP); Eiji Funabashi, Minamiashigara (JP); Kazuo Sueyoshi, Minamiashigara (JP); Hiroyuki Miura, Minamiashigara (JP); Masato Ono, Minamiashigara (JP); Hiroshi Takayama, Minamiashigara (JP); Naoki Ohnishi, Minamiashigara (JP); Jin Kasono, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/141,937

(22) Filed: May 10, 2002

(65) Prior Publication Data

US 2003/0099487 A1 May 29, 2003

(30) Foreign Application Priority Data

Nov. 28, 2001 (JP) ..... 2001-363041

(51) Int. Cl.[7] ..... G03G 9/08; G03G 15/02; G03G 15/08

(52) U.S. Cl. ..... 399/176; 399/252; 430/110.1; 430/110.4; 430/111.4

(58) Field of Search ..... 399/176, 174, 399/252, 222; 430/902, 110.1, 110.3, 110.4, 111.4, 120

(56) References Cited

U.S. PATENT DOCUMENTS 6,238,834 B1 * 5/2001 Tamura et al. ..... 430/106.1
6,416,918 B2 * 7/2002 Matsumura et al. ..... 430/110.4
6,453,146 B1 * 9/2002 Yamada et al. ..... 399/350

* cited by examiner

*Primary Examiner*—Sophia S. Chen
(74) *Attorney, Agent, or Firm*—Oliff & Berridge, PLC

(57) ABSTRACT

An image forming device which is capable of preventing generation of toner filming and obtaining a stable image quality without defects over a long period and which is environmentally friendly. The image forming device, for forming an image with a spherical toner, includes image holding members, contact type charging member, exposing member, developing member, and transfer member. A toner shape change ratio (Tt) of deformed toner particles passed between the contacting portions of the image holding members and the charging member is in a range of 50 to 100 percent.

18 Claims, 3 Drawing Sheets

EVALUATION OF THE FILMING LIFE USING THE IMAGE FORMING DEVICES OF THE EXAMPLES AND THE COMPARATIVE EXAMPLES

IMAGE FORMING DEVICE

BACKGROUND OF THE INVENTION

1. Field of the Invention

The present invention relates to a small-size image forming device utilizing electrophotography, such as a copying machine, a printer or a composite machine. More specifically, it relates to an image forming device with improvements for solving problems which occur when using a substantially spherical toner.

2. Description of the Related Art

In an image forming device utilizing the electrophotography method, an image is formed by forming an electrostatic latent image on a surface of an image holding member comprising an organic photoreceptor of a drum or belt shape, or the like, by a known electrophotographic process, developing the electrostatic latent image with a toner so as to obtain a toner image, electrostatically transferring the toner image onto a recording paper directly or via an intermediate transfer member, and fusing the toner onto a surface of the recording paper by heating, or the like.

A dry toner, in which a colorant, a charge controlling agent, or the like is dispersed into a resin that is the main component, and which is caused to take a particulate form as needed, is mainly used as the toner. Regardless of whether a toner is specified as a one-component developing agent or a two-component developing agent, most such dry toners are produced by the so-called mechanical pulverization method including steps of homogeneous dispersion by kneading a colorant, or the like, into a resin that is the main component, mechanical pulverization and classification so as to obtain desired particle size and particle distribution.

In view of the recent demand for high image quality, toner of reduced particle size and narrow distribution of particle size is desired for use in such image forming devices. When the distribution of particle size is wide, the ratio of toner having a small particle relative to toner having a large particle size, or vice versa, is increased so as to generate the following problems. In the case of toner wherein the amount of small particles is large, the toner tends to scatter from the developer thereby contaminating the interior of the image forming device, or the like. Also, in the case of a two-component developing agent, since the toner can easily adhere to a carrier, the toner charge property is deteriorated. In contrast, in the case of toner wherein the amount of large particles is large, there are problems such as a tendency for image quality deterioration, or the like.

However, in the case in which a toner of small particle size and narrow particle size distribution is produced by the above-mentioned method of mechanical pulverization, the production ability and the yield are drastically lowered, thereby increasing the cost. Therefore, as a method for producing such a toner, wet methods such as polymerization and dissolution have been proposed.

In the polymerization method toner particles are obtained via a polymerization reaction and granulation of a combination of a monomer and a colorant, or the like. Since the particle size can be controlled by adjusting the reaction time, or the like, theoretically it is said that extremely narrow particle distribution is possible.

Moreover, in the dissolution method toner particles are obtained via preparation of an oil phase by dissolving or dispersing a binder resin and a colorant, or the like, in an organic solvent, and suspension granulation of the oil phase component in a water phase. In this production method a reduction in particle size and control of particle size distribution control can be achieved.

It is characteristic of a toner obtained via the wet methods such as polymerization and dissolution to have a substantially spherical particle shape. In contrast, a toner obtained by the above-mentioned mechanical pulverization method generally has an amorphous particle shape. Therefore, compared with the amorphous toner obtained by the mechanical pulverization method, it is known that toner produced via the wet methods has the advantage of extremely improved transfer efficiency since the substantially spherical toner of small particle size has a small contact area with the surface of the image holding member whereby the adhesion force of the toner with regards to the surface of the image holding member is small. Due to such a high transfer efficiency and the fact that less toner is wasted, it is possible to reduce the amount of toner used in comparison with conventional toners, thereby making it economical and environmentally friendly.

However, since toner obtained by the wet methods has a substantially spherical particle shape, it is known to have the following disadvantage. When either toner remaining on the surface of the image holding member after transfer in an image forming device without a cleaning device, or toner remaining on the surface of the image holding member after passing through a cleaning step in an image forming device having a cleaning device, passes between contacting portions of a contact charger and an image holding member, the toner is deformed so as to adhere to the surface of the image holding member. When this occurs, repetition of the adhesion results in toner filming, wherein the toner becomes fixed to the surface of the image holding member as a foreign substance.

When the image formation is executed after toner filming has occurred, residual images or stripes are generated on the obtained image deteriorating the image quality. In the case where a contact charger such as a charge roll with a small diameter is used for providing a small image forming device, improvements with respect to both charge failure and the above-mentioned toner filming have yet to be achieved.

In particular, in the case where a spherical toner of small particle size obtained by the wet methods is used, it has been extremely difficult to prevent generation of toner filming in a conventional image forming device having a cleaning device such as a cleaning blade or in an image forming device without a cleaning device wherein residual toner is collected by the developer.

For example, in an image forming device having a cleaning device such as a cleaning blade, since a small-particle spherical toner cannot be cleaned sufficiently, the toner passes under the blade. Therefore, the above-mentioned toner passes between the contacting portions of the image holding member and the contact charger. At the time, the toner is deformed by the contact charger and thereby adhered to the surface of the image holding member. Therefore, due to repetition of the adhesion, the toner is fixed on the surface of the image holding member generating the so-called toner filming and having the adverse effect on image quality.

Moreover, in an image forming device without a cleaning device wherein the residual toner is collected by the developer, the toner remaining on the surface of the image holding member after transfer passes between the contacting portions of the surface of the image holding member and the contact charger. At the time, the above-mentioned toner is deformed by the contact charger and thereby adheres to the surface of the image holding member. Therefore, due to repetition of the adhesion, the toner is fixed on the surface of the image holding member generating the so-called toner filming and having adverse effects on image quality.

SUMMARY OF THE INVENTION

An object of the present invention is to solve the above-mentioned problems. That is, an object thereof is to provide an image forming device capable of preventing generation of toner filming while obtaining a stable image quality without defects over a long period, and which is environmentally friendly, by restraining an amount of a spherical toner remaining on a surface of an image holding member after transfer and deformed as it passes through contacting portions of the image holding member and a contact charger in the case of forming an image using the spherical toner.

The above-mentioned object can be achieved by the present invention described below. That is, according to a first aspect, the present invention provides an image forming device comprising an image holding member, a contact type charging means for charging a surface of the image holding member by making contact therewith, an exposing means for forming an electrostatic latent image by exposing the surface of the image holding member charged by the contact-type charging means according to image information, a developing means for developing the electrostatic latent image via a spherical toner so as to provide a toner image, and a transfer means for electrostatically transferring the toner image from the surface of the image holding member to a transfer material, wherein a toner shape change ratio (Tt) of deformed toner particles passed between contacting portions of the image holding member and the contact charger, expressed by the following formula (1), is within a range of 50 to 100 percent:

$$Tt(\%)=(h/x)\times 100 \qquad \text{Formula (1)}$$

In the formula (1), x denotes a maximum length ($\mu$m) of a deformed toner particle projected image, h denotes a maximum length ($\mu$m) of the deformed toner particle projected image formed on a surface perpendicular to an axis in the maximum length direction of the deformed toner particle projected image, and $x \geqq h$.

According to a second aspect, the present invention provides an image forming device, wherein a shape index (SF) of the spherical toner, expressed by the following formula (2), is 135 or less:

$$SF=(2\pi L^2/4A)\times 100 \qquad \text{Formula (2)}$$

In the formula (2), L denotes the maximum length ($\mu$m) of the spherical toner particle projected image, and A denotes an area ($\mu m^2$) of the spherical toner particle projected image.

According to a third aspect, the present invention provides an image forming device, wherein a volume average particle size of the spherical toner is within a range of 2 $\mu$m to 9 $\mu$m.

According to a fourth aspect, the present invention provides an image forming device wherein the contact charger is a charge roll, comprising a rotating member, at least one intermediate layer disposed on a surface of the rotating member, and an elastic member provided further on the surface, and a diameter of the charge roll is in a range of 6 mm to 13 mm.

DESCRIPTION OF THE PREFERRED EMBODIMENTS

Figure 1:
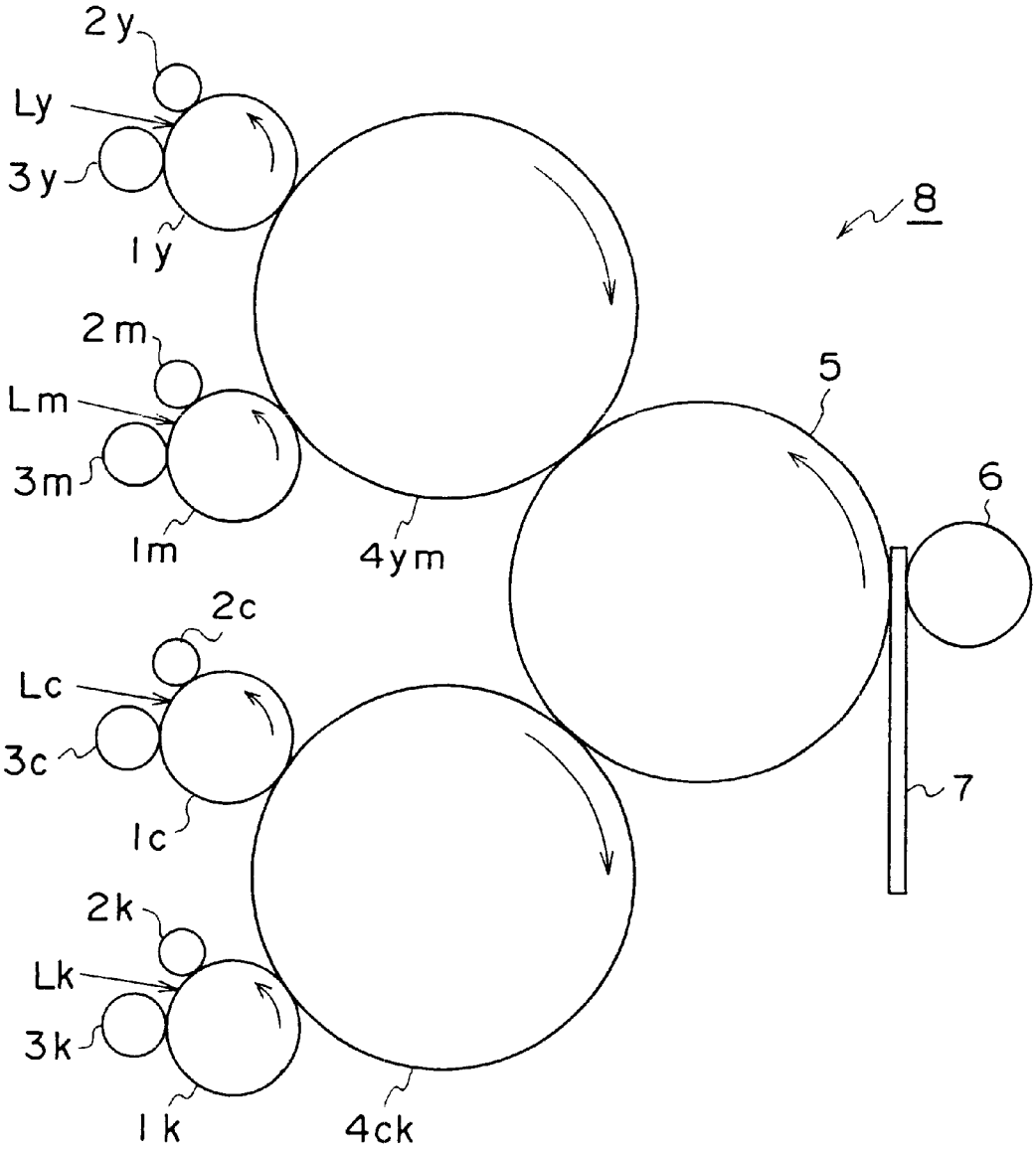
FIG. 1 is a schematic configuration diagram showing an example of an image forming device according to the present invention.

An image forming device according to the present invention comprises an image holding member, a contact-type charging means for charging the surface of the image holding member by making contact therewith, an exposing means for forming an electrostatic latent image by exposing the surface of the image holding member charged by the contact-type charging means according to image information, a developing means for developing the electrostatic latent image via a spherical toner so as to provide a toner image, and a transfer means for electrostatically transferring the toner image from the surface of the image holding member to a transfer material, wherein a toner shape change ratio (Tt) of deformed toner particles passed between contacting portions of the image holding member and the contact charger, represented by a following formula (1) is in a range of 50% to 100%. The toner shape change ratio (Tt) is preferably in a range of 65% to 100%, and more preferably in a range of 80% to 100%:

$$Tt(\%)=(h/x)\times 100 \qquad \text{Formula (1)}$$

(in the formula (1), x denotes a maximum length ($\mu$m) of a deformed toner particle projected image, h denotes a maximum length ($\mu$m) of the deformed toner particle projected image formed on the surface perpendicular to an axis in the maximum length direction of the deformed toner particle projected image, and $x \geqq h$.

In the case where the toner shape change ratio (Tt) is within the above-mentioned range, when the spherical toner remaining on the surface of the image holding member transfer passes between the contacting portions of the image holding member and the contact charger, the amount of deformed toner is small, and therefore generation of toner filming can be prevented so that a stable image quality without defects can be obtained over a long period. Moreover, since a spherical toner is used, toner is not wasted, and thus it is environmentally friendly.

In contrast, in the case where the toner shape change ratio (Tt) is less than 50%, the amount of the deformed toner is large, and thus toner filming is generated at an early stage making it impossible to obtain a stable image quality without defects over a long period.

In the previous description of the present invention, the terms "spherical toner", "deformed toner", "toner shape change ratio (Tt)", "toner particle projected image" and "transfer material" specifically and accurately have the meanings explained below.

That is, the "spherical toner" in the present invention represents both those having a completely spherical shape and those having a nearly spherical shape. The quantitative property represented by the "spherical" will be explained later. Moreover, the above-mentioned spherical toner is generally produced via wet methods such as polymerization and dissolution. However, as long as a substantially spherical toner can be obtained, the production method thereof is not particularly limited. For example, it can be produced via another method such as mechanical pulverization.

In contrast, the "deformed toner" in the present invention denotes the spherical toner adhered to the surface of the image holding member after transfer, which has passed between the contacting portions of the image holding member and the contact charger. In general, the toner tends to be deformed from the original shape more or less according to the pressure, or the like, applied at the time of passing between the contacting portions.

The "toner shape change ratio (Tt)" is determined by sampling at least 50 of the deformed toner particles after passing through the contacting portions of the image holding member and the contact charger, substituting the projected image maximum length×(μm) of each deformed toner particle, and the deformed toner particle projected image maximum length (μm) formed on the surface perpendicular to the axis of the deformed toner particle projected image maximum length direction into the above-mentioned formula (1), and averaging the obtained values. The x value and the h value of each sampled toner particle are measured by an image analysis device, NEXUS (produced by NEXUS Co., Ltd.).

Moreover, in the definition of the x value and the h value, the "toner particle projected image" denotes the projected image of the toner particle formed on a flat screen surface when a toner particle, such as a spherical toner or a deformed toner, is disposed between a flat screen and a light source for directing a light beam thereto substantially perpendicularly. The same is applied to the description below.

As to the "toner shape change ratio (Tt)", a desired value can be obtained by controlling various factors such as the spherical toner to be used, the contact charger and the image holding member. As an example of such a factor, although it is not particularly limited, it is preferable to take into consideration the hardness of the spherical toner, and, in the case where the contact charger is a charge roll, the surface hardness thereof. The former can be controlled by appropriately selecting the production method of the spherical toner, the production conditions, or the like, and the latter can be controlled by appropriately selecting the configuration of the layers comprising the charge roll, the material and the thickness of the layers, or the like.

The "transfer material" denotes both an intermediate transfer member to be used when indirectly transferring the toner image on the surface of the image holding member to a recording material, such as a recording paper or an OHP sheet, and the above-mentioned recording material to be used when directly transferring the toner image.

The "spherical" degree of the spherical toner used in the present invention can be represented quantitatively by the shape index (SF) represented by a below-mentioned formula (2). In a case where the value is 100, it denotes a complete sphere, and a value close to 100 denotes that a shape is close to the complete sphere. In the present invention, the shape index (SF) is preferably 135 or less, and more preferably 125 or less:

$$SF=(2\pi L^2/4A)\times 100 \qquad \text{Formula (2)}$$

(in the formula (2), L denotes the maximum length (μm) of the spherical toner particle projected image, and A denotes the area ($\mu m^2$) of the spherical toner particle projected image.).

In a case where the shape index (SF) exceeds 135, since the contact area of the spherical toner with respect to the surface of the image holding member becomes large, the adhesion force of the spherical toner with respect to the surface of the image holding member becomes great, and thus transfer efficiency may be deteriorated. Therefore, in this case, the amount of wasted toner (toner not utilized in image formation) is increased, and thus it is not preferable economically and environmentally.

The shape index (SF) is determined by measuring the projected image maximum length L (μm) and the area of the spherical toner particle projected image ($\mu m^2$) for each of 100 of the spherical toner particles obtained via the polymerization method, or the like by the above-mentioned image analysis device, NEXUS (produced by the NEXUS Co., Ltd.), and averaging the values obtained by substituting these values into the above-mentioned formula (2).

The volume average particle size of the spherical toner used in the present invention is preferably in a range of 2 μm to 9 μm, and more preferably in a range of 5 μm to 8 μm.

In a case where the volume average particle size is less than 2 μm, the spherical toner can easily be scattered from the developer, and the inside of the image forming device can thereby be polluted. Moreover, in the case of a two-component developing agent, since the above-mentioned toner can easily be adhered to the carrier, the toner charge property may be lowered. In contrast, in a case where the volume average particle size exceeds 9 μm, there may be problems such as a tendency for the image quality to deteriorate. The production method of the spherical toner, the materials used therein, the elastic modulus, or the like usable in the present invention are disclosed in Japanese Patent Application Laid-Open. (JP-A) Nos. 11-194542, 2001-265050, 2001-166659, and 10-10775.

In a case where the contact charger used in the present invention is a charge roll comprising on the surface of a rotating member an intermediate layer including at least one layer, and a surface layer comprising an elastic member formed on the surface of the intermediate layer, the diameter of the charge roll is preferably in a range of 6 mm to 13 mm, and more preferably in a range of 7.5 mm to 10.5 mm.

In a case where the diameter of charge roll is less than 6 mm, local charge failure can be generated at the nip (contacting portions) of the image holding member and the charge roll, since the former and the latter tend not to make contacted evenly. In contrast, in a case where the diameter of the charge roll exceeds 13 mm, production of a small-size image forming device can be difficult.

An embodiment of an image forming device of the present invention will now be explained with reference to the drawings, but the present invention is not limited to the embodiment shown therein.

FIG. 1 is a schematic configuration diagram showing an embodiment of an image forming device 8 of the present invention. The image forming device 8 shown in FIG. 1 is a full color image forming device without a cleaning device, which utilizes electrophotography and laser beam scan-exposing methods. The image forming device 8 comprises four image holding members 1y, 1m, 1c, and 1k; four contact chargers 2y, 2m, 2c, and 2k; four developers 3y, 3m, 3c, and 3k; two primary transfer rolls 4ym and 4ck; a secondary transfer roll 5; a pressure roll 6; and image supporting members 1y, 1m, 1c, and 1k for respectively forming four color toner images of Y (yellow), M (magenta), C (cyan) and K (black). As the four color image holding members, negatively chargeable organic photoreceptors are used.

Moreover, the arrows Ly, Lm, Lc, and Lk shown in FIG. 1 denote laser beam irradiation from an unshown light source, in the direction of each arrow. The lower-case letters following the numerals, that is, y, m, c and k, represent a color or colors associated with each member comprising the image forming device 8 in the process for forming a color image on a surface of a recording material 7. y denotes yellow, m denotes magenta, c cyan denotes and k denotes black.

Around each of the image forming members 1y, 1m, 1c, and 1k, along a rotation direction thereof (the direction of an arrow shown in each of the image holding members 1y, 1m, 1c, and 1k in FIG. 1). The contact chargers 2y, 2m, 2c, and 2k, the developers 3y, 3m, 3c, and 3k, and the primary transfer rolls 4ym and 4ck are provided respectively and successively. The image holding members, the contact chargers and the developers are provided in sets comprising one of each, with each set corresponding to one of the four colors. For example, in the case of yellow, the contact charger 2y and the developer 3y are disposed around the image holding member 1y. A laser beam Ly for forming an electrostatic latent image on a surface of the rotating image holding member 1y based on yellow image information is directed at the surface between where the surface makes contact with the contact charger 2y and where the surface is adjacent to and faces the developer 3y. The same structure is respectively applied to the components corresponding to the other three colors.

The primary transfer roll 4ym is provided in contact with the rotating image holding members 1y and 1m so as to be rotated, interlocked therewith. The primary transfer roll 4ck is provided in contact with the rotating image holding members 1c and 1k so as to be rotated, interlocked therewith. Moreover, the secondary transfer roll 5 is provided in contact with the primary transfer rolls 4ym and 4ck so as to be rotated, interlocked therewith. Furthermore, the secondary transfer roll 5 and the pressure roll 6 make contact such that when the recording material 7 passes between the contacting portions thereof, an image is formed on the surface of the recording material 7 on the secondary roll 5 side thereof.

The image holding members 1y, 1m, 1c, and 1k are charged respectively and uniformly by the contact chargers 2y, 2m, 2c, and 2k. Then, electrostatic latent images are respectively formed on the surfaces of the image holding members 1y, 1m, 1c, and 1k by the modulated laser beams Ly, Lm, Lc, and Lk. The electrostatic latent images on the surfaces of the image holding members 1y, 1m, 1c, and 1k are respectively developed into toner images by the developers 3y, 3m, 3c, and 3k. The developed toner images are transferred by the primary transfer rolls, with each primary transfer roll transferring toner images of two of the colors. That is, the yellow toner image and the magenta toner image are transferred on the primary transfer roll 4ym, and the cyan toner image and the black toner image are transferred on the primary transfer roll 4ck. The toner images transferred on the primary transfer rolls 4ym, 4ck are transferred onto the secondary transfer roll 5. When the recording material 7 is inserted between the contacting portions of the secondary transfer roll 5 and the pressure roll 6, the color toner images transferred on the secondary transfer roll 5 are transferred collectively onto the surface of the recording material 7. A positively charged bias is applied to the primary transfer rolls 4ym and 4ck, the secondary transfer roll 5 and the pressure roll 6 by an unshown power source for electrostatically transferring a negatively charged toner.

In a case where the contact type chargers 2y, 2m, 2c, and 2k of the image forming device 8 of the above-described configuration comprise a conductive or semi-conductive roller (hereinafter abbreviated as "charge roll"), a direct current is generally applied to the image holding members 1y, 1m, 1c, and 1k, but an alternating current may further be applied, superimposed thereon.

The image holding members 1y, 1m, 1c, and 1k are generally charged to −300 to −1,000 V by the above-mentioned charging means. In the case where the contact type chargers 2y, 2m, 2c, and 2k comprises charge rolls in the present invention, each is provided with a rotating members, an intermediate layer comprising at least one layer disposed at an outer surface of the rotating member, and a surface layer comprising at least an elastic member disposed at an outer surface of the intermediate layer. However, a configuration with only the rotating member and the surface layer, comprising at least the elastic member disposed at the outer surface of the rotating member, can be adopted as well.

Figure 2:
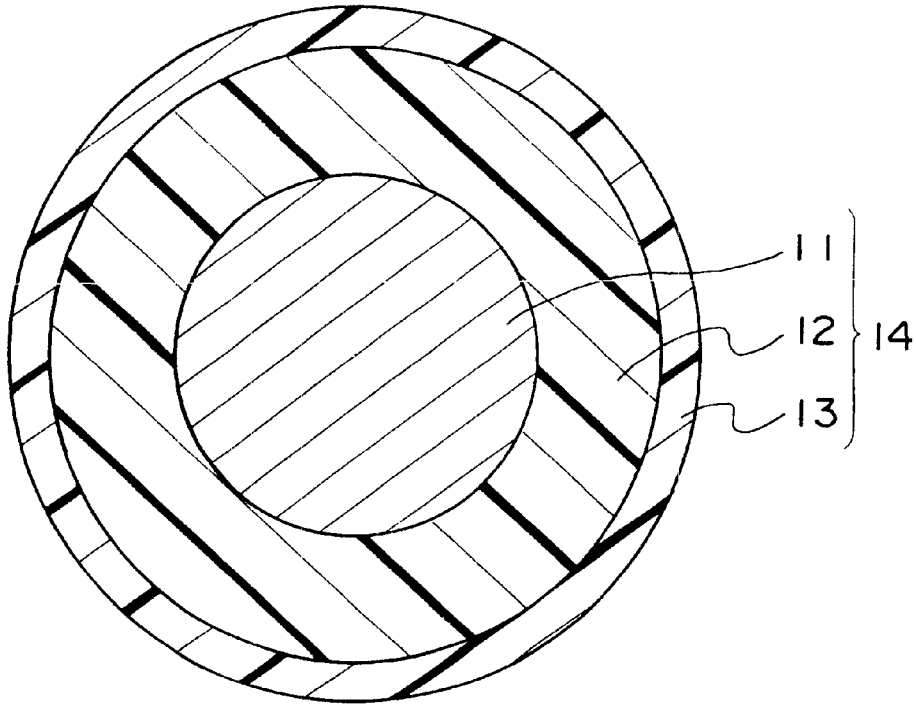
FIG. 2 is a schematic cross-sectional view showing an example of the layer configuration of a charge roll in the case a contact charger used in an image forming device of the present invention is a charge roll.

FIG. 2 is a schematic cross-sectional view showing a layer structure in an embodiment of a charge roll 14 in the case where the contact chargers used in an image forming device of the present invention comprise charge rolls.

In FIG. 2, the charge roll 14 comprises a rotating member 11 such as a shaft made of a material having the rigidity such as a metal, an intermediate layer 12 comprising at least one layer formed on an outer surface of the rotating member 11, and a surface layer 13 comprising an elastic member formed on an outer surface of the intermediate layer 12.

The elastic member of the surface layer 13 is semi-conductive. Moreover, as the binder material for the elastic member, rubber materials such as an SBR (styrene butadiene rubber), a BR (polybutadiene rubber), a hi styrene rubber (hi styrene resin master batch), an IR (isoprene rubber), an IIR (butyl rubber) a halogenated butyl rubber, an NBR (nitrile butadiene rubber), a hydrogenated NBR (H-NBR), an EPDM (ethylene-propylene-diene three element copolymer rubber), an EPM (ethylene propylene rubber), a rubber obtained by blending the NBR and the EPDM, a CR (chloroprene rubber), an ACM (acrylic rubber), a CO (hydrin rubber), an ECO (epichlorohydrin rubber), a chlorinated polyethylene (chlorinated-PE), a VAMAC (ethylene-acrylic rubber), a VMQ (silicone rubber), an AU (urethane rubber), an FKM (fluorine rubber), an NR (natural rubber) and a CSM (chlorosulfonated polyethylene rubber), are possible example. As long as the binder material for the elastic member is a rubber material, however, it is not particularly limited, and thus rubber materials other than those mentioned above can be used as well.

The intermediate layer 12 is conductive or semi-conductive. As the binder material for the intermediate layer 12, rubber materials such as an SBR (styrene butadiene rubber), a BR (polybutadiene rubber), a hi styrene rubber (hi styrene resin master batch), an IR (isoprene rubber), an IIR (butyl rubber) a halogenated butyl rubber, an NBR (nitrile butadiene rubber), a hydrogenated NBR (H-NBR), an EPDM (ethylene-propylene-diene three element copolymer rubber), an EPM (ethylene propylene rubber), a rubber obtained by blending the NBR and the EPDM, a CR (chloroprene rubber), an ACM (acrylic rubber), a CO (hydrin rubber), an ECO (epichlorohydrin rubber), a chlorinated polyethylene (chlorinated-PE), a VAMAC (ethylene-acrylic rubber), a VMQ (silicone rubber), an AU (urethane rubber), an FKM (fluorine rubber), an NR (natural rubber) and a CSM (chlorosulfonated polyethylene rubber), are possible examples.

Furthermore, in addition to the above-mentioned rubber materials, resin materials such as a PVC, a polyethylene, a polypropylene, a polystyrene, a polyester, a polyurethane, a polyamide, a polyimide, a nylon, a vinyl ethylene acetate, an ethylene ethyl acrylate, a methyl ethylene acrylate, a styrene butadiene, a polyallylate, a polycarbonate, a Teflon (R) and a silicone, single polymers of a styrene and a substituent thereof, such as a polystyrene and a polyvinyl toluene, styrene based copolymers, such as a styrene-propylene copolymer, a styrene-vinyl toluene copolymer, a styrene vinyl naphthalene copolymer, a styrene-methyl acrylate copolymer, a styrene-ethyl acrylate copolymer, a styrene-butyl acrylate copolymer, a styrene-octyl acrylate copolymer, a styrene-dimethyl amino ethyl acrylate copolymer, a styrene-methyl methacrylate copolymer, a styrene-ethyl methacrylate copolymer, a styrene-butyl methacrylate copolymer, a styrene-dimethyl amino ethyl methacrylate copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer, a styrene-maleic acid copolymer and a styrene-ester maleate copolymer, and resins such as a polymethacrylate, a polybutyl methacrylate, a polyvinyl acetate, a polyethylene, a polypropylene, a polyvinyl butylal, a polyacrylic acid resin, a rosin, a modified rosin, a terpene resin, a phenol resin, an aliphatic or alicyclic hydrocarbon resin, an aromatic petroleum resin, a paraffin wax and a carnauba wax, are other possible examples. The binder materiel for the intermediate layer 12 can be selected from the above-mentioned copolymers, the modified materials, or a mixture thereof. As long as the binder material is a rubber material, a resin material, a copolymer material or a mixture thereof, however, it is not particularly limited, and materials other than those mentioned above can be used as well.

As the image holding members 1y, 1m, 1c, and 1k, any having at least the function of forming a latent image can be used without limitation, but a photoreceptor for electrophotography can be used preferably. The photoreceptor for electrophotography may be of a single-layer type provided with a deposition film of a charge generating substance, or the like, but, in the present invention, a piled type photoreceptor for electrophotography of a function separated type can be used preferably.

As the exposing means, although a laser beam is used in the image forming device 8 shown in FIG. 1, it is not limited thereto, and optical appliances capable of exposing a desired image on the surface of the image holding members 1y, 1m, 1c, and 1k via a light source such as a semiconductor laser beam, an LED beam or a liquid crystal shutter beam, or the like can be used.

The developers 3y, 3m, 3c, and 3k are not particularly limited as long as they have a function of forming a toner image via the spherical toner by developing the electrostatic latent image formed on the surface of the image holding members 1y, 1m, 1c, and 1k. For example, a known developer having a function of causing the spherical toner to adhere to the image holding members 1y, 1m, 1c, and 1k using a brush, a roller, or the like, can be used.

As the transfer current to be applied from the image holding members 1y, 1m, 1c, and 1k to the primary transfer rolls 4ym and 4ck, and furthermore from the primary transfer rolls 4ym and 4ck to the secondary transfer roll 5, a direct current is generally used. In the present invention, however, an alternating current can further be superimposed and used. The setting conditions of the primary transfer rolls 4ym and 4ck and the secondary transfer roll 5 can be selected optionally according to a width of an image area to be charged, a transfer charger shape, an opening width, a processing speed (circumferential velocity), or the like.

As the transfer current to be applied from the pressure roll 6 to the recording material 7, in general, a direct current is used. However, in the present invention, an alternative current can further be superimposed and used. The setting conditions of the pressure roll 6 can be selected optionally according to the image area width to be charged, the transfer charger shape, the opening width, the processing speed (circumferential velocity), or the like.

EXAMPLES

Hereinafter, the present invention will be explained further, specifically with reference to examples thereof and comparative examples. The present invention, however, is not limited to the examples described below.

In each of the examples and the comparative examples, image formation was continuously executed using the image forming device 8 of the present invention shown in FIG. 1 until toner filming was generated. As the toners of the four colors including the Y (yellow), the M (magenta), the cyan (C) and the K (black), a spherical toner having a volume average particle size of 7 $\mu$m to 8 $\mu$m and a shape index (SF) of 110 produced by the dissolution method was used as the negatively charged two-component developing agent. As the contact chargers 2y, 2m, 2c, and 2k, the semi-conductive charge rolls 14 having an 8 mm diameter and comprising the intermediate layer 12 comprising one layer and the surface layer 13 formed successively on the surface of the rotating member 11 comprising a metal shaft having a 5 mm diameter and a 300 mm width, was used.

In the examples and the comparative examples, tests were executed wherein the toner shape change ratio (Tt) changed due to changas in the material, the thickness, or the like, of the intermediate layer 12 and the surface layer 13 of each of the charge rolls 14.

Example 1

As the image forming device 8 of the example 1, one the charge rolls 14, each comprising the foamed urethane intermediate layer 12 of a 1,000 $\mu$m thickness, and the epichlorohydrin rubber surface layer 13 of a 500 $\mu$m thickness was used. The toner shape change ratio (Tt) of the image forming device 8 of the example 1 was 99%.

Next, a continuous image formation test of forming 14 patterns including characters, half tones, photographic images, and the like, by the image forming device 8 of the example 1 using an A4 size P paper (produced by Fuji Xerox) as the recording material 7 until toner filming generation was observed.

Example 2

As the image forming device 8 of the example 2, one having the charge roll 14 comprising a 500 $\mu$m thickness foamed urethane intermediate layer 12, and the 1,000 $\mu$m epichlorohydrin rubber surface layer 13, was used. The toner shape change ratio (Tt) of the image forming device 8 of the example 2 was 92%. Next, the same test as that in the example 1 was executed by the image forming device 8 of the example 2.

Example 3

As the image forming device 8 of the example 3, one having the charge roll 14 comprising a 1,000 $\mu$m thickness foamed silicone intermediate layer 12, and the 500 $\mu$m silicone rubber surface layer 13, was used. The toner shape change ratio (Tt) of the image forming device 8 of the example 3 was 86%. Next, the same test as that in the example 1 was executed by the image forming device 8 of the example 3.

Example 4

As the image forming device 8 of the example 4, one having the charge roll 14 comprising a 700 $\mu$m thickness foamed urethane intermediate layer 12, and the 800 μm epichlorohydrin rubber surface layer 13, was used. The toner shape change ratio (Tt) of the image forming device 8 of the example 4 was 78%. Next, the same test as that in the example 1 was executed by the image forming device 8 of the example 4.

Example 5

As the image forming device 8 of the example 5, one having the charge roll 14 comprising a 1,000 μm thickness foamed EPDM intermediate layer 12, and the 500 μm epichlorohydrin surface layer 13, was used. The toner shape change ratio (Tt) of the image forming device 8 of the example 5 was 65%. Next, the same test as that in the example 1 was executed by the image forming device 8 of the example 5.

Example 6

As the image forming device 8 of the example 6, one having the charge roll 14 comprising an 800 μm thickness foamed EPDM intermediate layer 12, and the 700 μm epichlorohydrin rubber surface layer 13, was used. The toner shape change ratio (Tt) of the image forming device 8 of the example 6 was 58%. Next, the same test as that in the example 1 was executed by the image forming device 8 of the example 6.

Comparative Example 1

As the image forming device 8 of the comparative example 1, one having the charge roll 14 comprising a 1,430 μm thickness foamed urethane intermediate layer 12, and the 70 μm PVDF (polyvinylidene fluoride) surface layer 13, was used. The toner shape change ratio (Tt) of the image forming device 8 of the comparative example 1 was 15%. Next, the same test as that in the example 1 was executed by the image forming device 8 of the comparative example 1.

Comparative Example 2

As the image forming device 8 of the comparative example 2, one having the charge roll 14 comprising a 1,450 μm thickness foamed urethane intermediate layer 12, and the 50 μm PVDF surface layer 13, was used. The toner shape change ratio (Tt) of the image forming device 8 of the comparative example 2 was 35%. Next, the same test as that in the example 1 was executed by the image forming device 8 of the comparative example 2.

Comparative Example 3

As the image forming device 8 of the comparative example 3, one having the charge roll 14 comprising a 1,400 μm thickness epichlorohydrin rubber intermediate layer 12, and the 100 μm polyester surface layer 13, was used. The toner shape change ratio (Tt) of the image forming device 8 of the comparative example 3 was 48%. Next, the same test as that in the example 1 was executed by the image forming device 8 of the comparative example 3.

(Evaluation Method for the Filming Life)

For the toner filming evaluation in the above-mentioned examples and the comparative examples, whether or not the defect exists in a color image formed on the recording material 7 surface was evaluated by the visual observation. The number of the formed images when the image defect starts to be generated was defined to be the filming life. Results of the filming life with respect to the toner shape change ratio (Tt) of the charge roll used in the above-mentioned examples and comparative examples are shown as a graph in FIG. 3.

(Evaluation)

Figure 3:
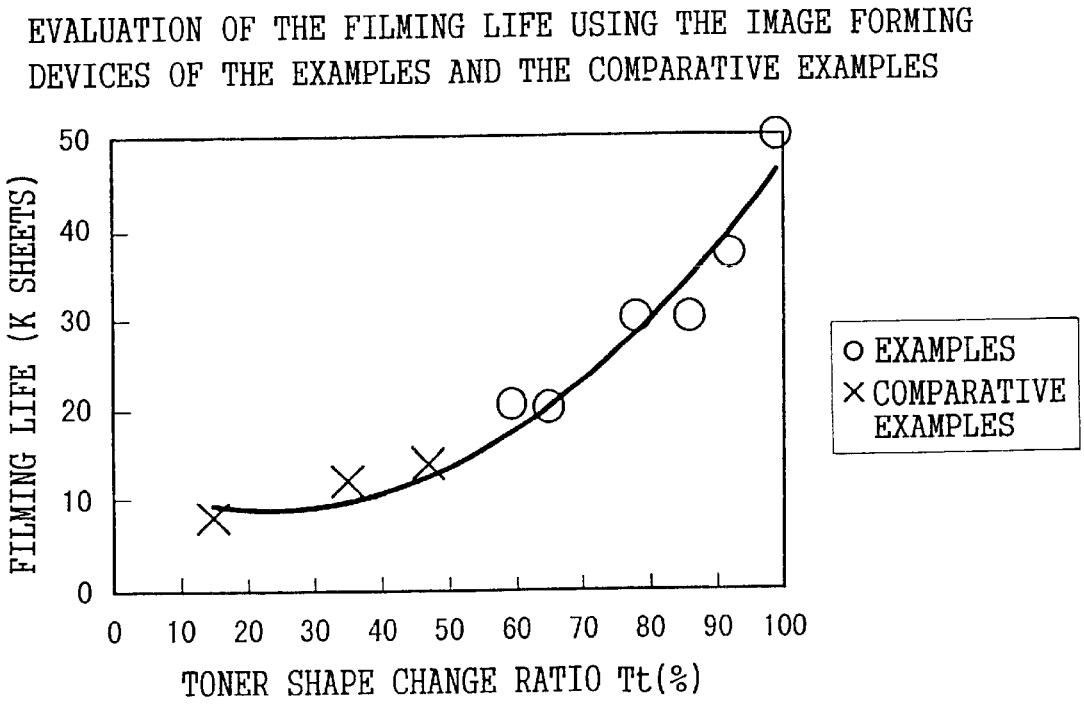
FIG. 3 is a graph showing filming life with respect to a toner shape change ratio of an image forming device (example) of the present invention and an image forming device (comparative example) using conventional techniques.

From the results shown in FIG. 3, it is learned that the filming life of the image forming devices (examples 1 to 6) of the present invention is 20K sheets or more, however, the filming life of the image forming devices (comparative examples 1 to 3) of the conventional technique is about 10K. Moreover, if the toner shape change ratio (Tt) reaches 50%, the filming life becomes about 13K sheets, that is, it is improved to 1.3 times compared with the comparative examples 1 and 2. Furthermore, if the toner shape change ratio Tt is 50% or more, the filming life is dramatically large so that the toner filming cannot be generated over a long period.

As heretofore explained, according to the present invention, an image forming device capable of preventing generation of the toner filming, obtaining a stable image quality without a defect over a long period and environment friendly can be provided, and it is extremely useful in the practical use.

What is claimed is:

1. An image forming device, comprising:

an image holding member;

means for charging a surface of the image holding member by making contact therewith;

means for forming an electrostatic latent image by exposing the surface of the image holding member charged by the charging means according to image information;

means for developing the electrostatic latent image via a spherical toner so as to provide a toner image; and means for electrostatically transferring the toner image from the surface of the image holding member to a transfer material;

wherein a toner shape change ratio (Tt) of deformed toner particles passed between the contacting portions of the image holding member and the charging means, represented by the following formula (1), is within a range of 50 to 100 percent, $$Tt(\%)=(h/x)\times 100 \qquad \text{Formula (1)}$$

and in the formula (1), x denotes a maximum length (μm) of a deformed toner particle projected image, h denotes a maximum length (μm) of the deformed toner particle projected image formed on a surface perpendicular to an axis in the maximum length direction of the deformed toner particle projected image, and $x \geqq h$.

2. The image forming device of claim 1, wherein the toner shape change ratio (Tt) is within a range of 80 to 100 percent.

3. The image forming device of claim 2, wherein a shape index (SF) of the spherical toner, represented by the following formula (2), is 135 or less, $$SF=(2\pi L^2/4A)\times 100 \qquad \text{Formula (2)}$$

and in the formula (2), L denotes a maximum length (μm) of a spherical toner particle projected image and A denotes an area ($\mu m^2$) of the spherical toner particle projected image.

4. The image forming device of claim 3, wherein the shape index (SF) of the spherical toner is 125 or less.

5. The image forming device of claim 4, wherein a volume average particle size of the spherical toner is within a range of 5 μm to 8 μm.

6. The image forming device of claim 5, wherein:

the charging means comprises at least one charge roll;

each charge roll has a rotating member, at least one intermediate layer disposed at an outer surface of the rotating member, and a surface layer, comprising at least an elastic member, disposed at an outer surface of the intermediate layer; and a diameter of the charge roll is in a range of 6 mm to 13 mm.

7. The image forming device of claim 5, wherein:

the charging means comprises at least one charge roll;

each charge roll has a rotating member, at least one intermediate layer disposed at an outer surface of the rotating member, and a surface layer, comprising at least an elastic member, disposed at an outer surface of the intermediate layer; and a diameter of the charge roll is in a range of 5.5 mm to 10.5 mm.

8. The image forming device of claim 4, wherein:

the charging means comprises at least one charge roll;

each charge roll has a rotating member, at least one intermediate layer disposed at an outer surface of the rotating member, and a surface layer, comprising at least an elastic member, disposed at an outer surface of the intermediate layer; and a diameter of the charge roll is in a range of 6 mm to 13 mm.

9. The image forming device of claim 3, wherein a volume average particle size of the spherical toner is within a range of 2 $\mu$m to 9 $\mu$m.

10. The image forming device of claim 3, wherein:

the charging means comprises at least one charge roll;

each charge roll has a rotating member, at least one intermediate layer disposed at an outer surface of the rotating member, and a surface layer, comprising at least an elastic member, disposed at an outer surface of the intermediate layer; and a diameter of the charge roll is in a range of 6 mm to 13 mm.

11. The image forming device of claim 1, wherein a shape index (SF) of the spherical toner, represented by the following formula (2), is 135 or less, $$SF=(2\pi L^2/4A)\times 100 \qquad \text{Formula (2)}$$

and in the formula (2), L denotes a maximum length ($\mu$m) of a spherical toner particle projected image and A denotes an area ($\mu m^2$) of the spherical toner particle projected image.

12. The image forming device of claim 11, wherein the shape index (SF) of the spherical toner is 125 or less.

13. The image forming device of claim 11, wherein a volume average particle size of the spherical toner is within a range of 2 $\mu$m to 9 $\mu$m.

14. The image forming device of claim 11, wherein:

the charging means comprises at least one charge roll;

each charge roll has a rotating member, at least one intermediate layer disposed at an outer surface of the rotating member, and a surface layer, comprising at least an elastic member, disposed at an outer surface of the intermediate layer; and a diameter of the charge roll is in a range of 6 mm to 13 mm.

15. The image forming device of claim 1, wherein a volume average particle size of the spherical toner is within a range of 2 $\mu$m to 9 m.

16. The image forming device of claim 1, wherein a volume average particle size of the spherical toner is within a range of 5 $\mu$m to 8 $\mu$m.

17. The image forming device of claim 1, wherein:

the charging means comprises at least one charge roll;

each charge roll has a rotating member, at least one intermediate layer disposed at an outer surface of the rotating member, and a surface layer, comprising at least an elastic member, disposed at an outer surface of the intermediate layer; and a diameter of the charge roll is in a range of 6 mm to 13 mm.

18. The image forming device of claim 1, wherein:

the charging means comprises at least one charge roll;

each charge roll has a rotating member, at least one intermediate layer disposed at an outer surface of the rotating member, and a surface layer, comprising at least an elastic member, disposed at an outer surface of the intermediate layer; and a diameter of the charge roll is in a range of 5.5 mm to 10.5 mm.

* * * * *